US005564608A

United States Patent [19]

Cooper

[11] Patent Number: 5,564,608

[45] Date of Patent: Oct. 15, 1996

[54] SAFETY GASOLINE CONTAINER

[75] Inventor: Clinton T. Cooper, Youngstown, Ohio

[73] Assignee: Safe-T-Way, Rockton, Ill.

[21] Appl. No.: 434,189

[22] Filed: May 3, 1995

[51] Int. Cl.[6] ..... B65D 47/06

[52] U.S. Cl. ..... 222/470; 220/203.27; 220/260; 220/303; 222/484; 222/543

[58] Field of Search ..... 222/470–474, 222/484, 529, 543, 505, 511, 518, 397, 192; 220/203.01, 203.1, 203.23, 203.27, 203.29, 260, 284, 303, 88.2, 89.1

[56] References Cited

U.S. PATENT DOCUMENTS

| | | | |
|---|---|---|---|
| D. 350,806 | 9/1994 | Cooper | D23/205 |
| 756,373 | 4/1904 | Joyce | 222/570 |
| 1,459,817 | 6/1923 | Bingay | 220/89.1 |
| 1,687,120 | 10/1928 | Blanchard | 222/570 X |
| 2,247,734 | 7/1941 | Schreiber | 220/203.23 |
| 2,319,517 | 5/1943 | Rand | 222/484 |
| 2,356,327 | 8/1944 | Lebus | 220/88.2 X |
| 2,547,847 | 4/1951 | Barclay | 222/571 X |
| 2,815,892 | 12/1957 | Richmond, Sr. | 222/470 |
| 2,915,224 | 12/1959 | Beall, Jr. | 222/484 X |
| 3,385,318 | 5/1968 | Kilbourn | 220/203.23 X |
| 3,727,807 | 4/1973 | Flider | 222/469 |
| 3,918,606 | 11/1975 | Keller | 220/303 X |
| 3,927,797 | 12/1975 | Flider | 222/471 X |
| 4,063,667 | 12/1977 | Flider | 222/470 |
| 4,834,270 | 5/1989 | Messner | 222/484 |
| 4,844,290 | 7/1989 | McCurdy et al. | 222/484 X |

OTHER PUBLICATIONS

Safe–T–Way sales brochure printed prior to Mar. 11, 1994.

*Primary Examiner*—Kevin P. Shaver
*Attorney, Agent, or Firm*—Browdy and Neimark

[57] ABSTRACT

A transportable safety gasoline container suitable for use in the workplace. The gasoline container has safety features that include, an automatically venting pour spout, a protective skirt on top of the gasoline container to prevent damage to valves and fittings, and a pressure relief cap which satisfies the various regulations associated with using gasoline containers in the workplace as well as for the transportation of such gasoline containers.

5 Claims, 4 Drawing Sheets

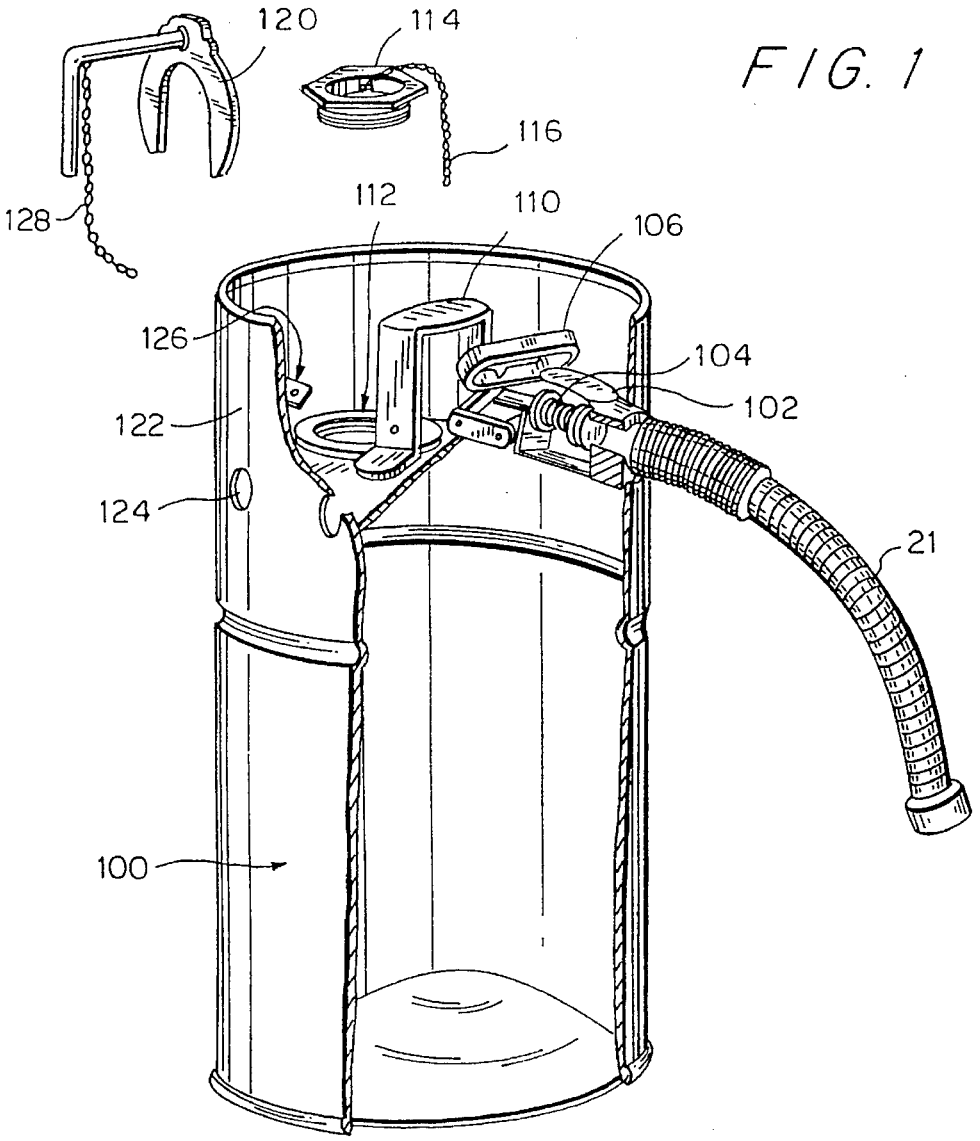
FIG. 1
FIG. 2
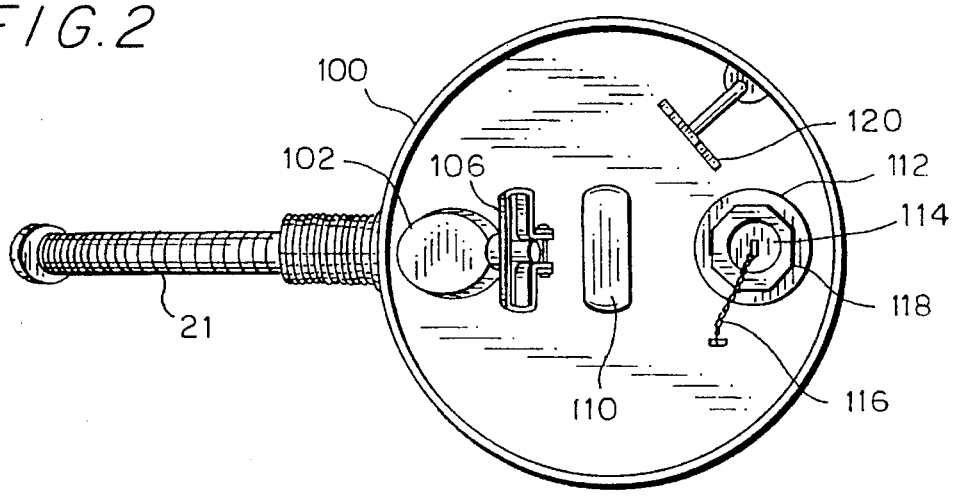

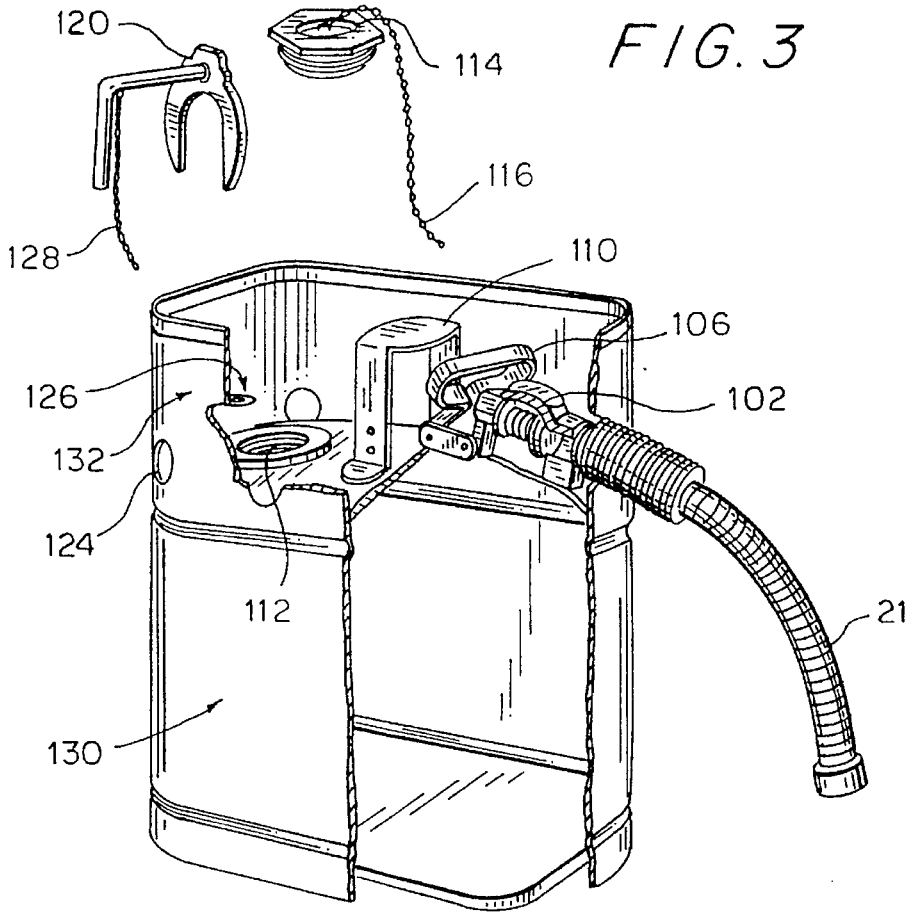
FIG. 3
FIG. 4
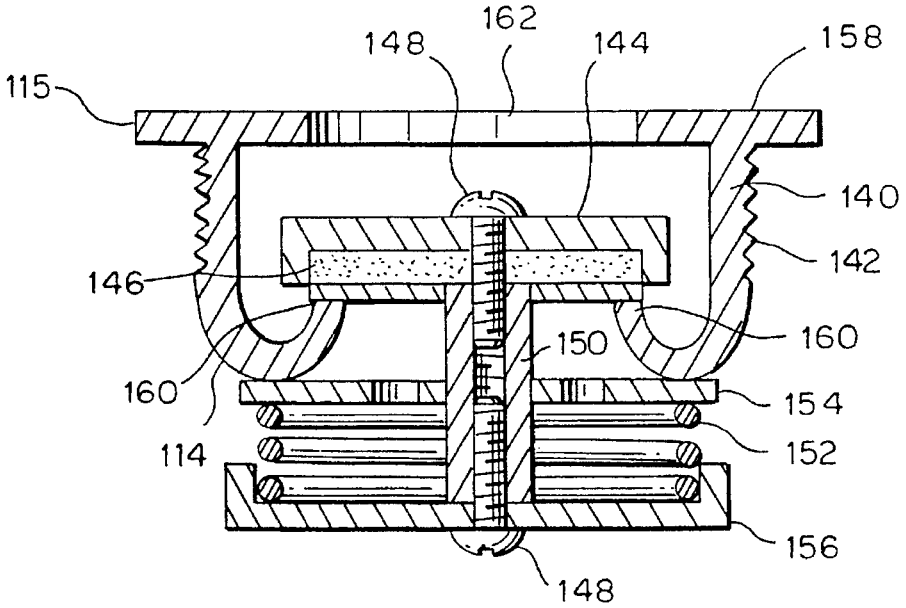

SAFETY GASOLINE CONTAINER

FIELD OF THE INVENTION

This invention relates to a novel combination of safety features for use with transportable gasoline containers intended for use in the workplace.

BACKGROUND OF THE INVENTION

In recent years, the public and especially industrial regulations have become more concerned that the design of transportable containers for storage and use of gasoline be designed to afford users and those proximate to those users maximum protection for safe handling of flammable liquids such as gasoline. If not so designed, unintentional discharge of the contents could increase, potentially resulting in a serious fire or explosion endangering nearby persons and property.

In response to this concern, industry associations have issued a number of regulations requiring that small containers directed to storage, transport and use of gasoline be designed with certain safety features depending on the intended use of the container. Thus, the standards set by the National Fire Protection Association and the American National Standards Institute requires an automatic spring closing cap and spout cover for closure of the fill spout of gasoline containers used in the workplace. The automatic spring closing cap and spout cover are intended to relieve the pressure build up in the container when a predetermined pressure is reached within the container that could result in explosion in the vicinity of the workplace. However, another regulation issued by the Department of Transportation (DOT) of the U.S. government equally concerned with safety in the transportation of gasoline on public highways has other pressure relief and drop test criteria for containers when filled with gasoline.

An additional requirement of the same regulation further requires that the valves and fittings of such small containers be protected from accidental damage when dropped, placed in compression when stacked, or subject to vibration up to predetermined test levels prescribed by the regulation.

The penalties for violation of these regulations is severe so as to impress upon users and manufacturers an incentive to comply and create designs which meet the requirements.

SUMMARY OF THE INVENTION

It is therefore, an object of this invention to provide a single container which meets all the requirements of the above-discussed regulations.

Another object of this invention is to provide a pressure relief cap for the fill spout of a small gasoline container during the container's use in the workplace or during its transport on public highways.

A further object of this invention is to provide means for protection of the valve and fitting of small gasoline containers, during use in the workplace or during vehicular transportation.

A still further object of the invention is to provide stability to tipping of a gasoline container in any direction.

Yet another object of the invention is to provide automatic vacuum venting during one-handed operation of the gasoline container pour valve.

These objects are attained according to the instant invention by engaging a novel pressure relief cap which can be threaded to the gasoline container according to the invention and utilized as intended by workplace regulations as well as by transportation regulations.

The threaded pressure relief cap is secured to a top portion of the container by a flexible chain or woven wire whether in is engaged to the fill spout or not. This precludes the possible loss of the cap when unfastened from the fill spout. The pressure relief cap is provided with a spring which cooperates with spring retainers, a gasket cap, and a gasket to form an airtight seal against the cap body. This airtight seal can be broken when the internal pressure inside the gasoline container is sufficiently high to overcome the force of the spring on the gasket seal.

Further, the pressure relief cap has a grip flange with multiple parallel sides to permit easy user fastening or removal of the caps to or from the container. A wrench with an opening mouth corresponding to the distance between the parallel sides of the grip flange is separately provided along with the container to further facilitate user removal and fastening of the pressure relief cap. When not in use, the wrench is detachably fixed to the top of the container. The wrench is further engaged to the container by a flexible chain or woven wire as is the pressure relief cap.

The valves and fittings, i.e. pour spout assembly and the pressure relief cap, are shielded as required by regulation from unintentional opening or damage. This is accomplished by providing a cylindrical or rectangular skirt integrally engaged on the periphery of the top surface of the gasoline container where such cap and pour spout are located. The protection skirt rises vertically from the periphery of the top of the container past both the uppermost point of the cap fastened to the fill spout and the pour spout. The skirt is provided with a plurality of drain holes proximate to the line of connection between the periphery of the top of the container and the skirt to permit drainage of water. In addition, a hole is provided on the skirt to permit passage of the flexible nozzle of the pour spout assembly and facilitate discharge of the contents of the container.

BRIEF DESCRIPTION OF THE DRAWINGS

In order that the container in which the above-recited advantages and objects of the invention are attained and can be understood in detail, more particular description of the invention may be had by reference to the specific embodiments thereof that are illustrated in the appended drawings, which drawings form a part of this specification and are hereafter described.

FIG. 1 is a perspective broken view of the gasoline container according to a first embodiment of the invention with pressure relief cap and wrench shown disengaged from the container fill spout and the wrench storage clip, respectively;

FIG. 2 is a top view of the gasoline container of FIG. 1;

FIG. 3 is a perspective broken view of the gasoline container according to a second embodiment of the invention with the pressure relief cap and the wrench shown disengaged from the container fill spout and the wrench storage clip;

FIG. 4 is a cross-sectional side view of a the pressure relief cap according to the invention;

FIG. 7A shows the plunger stem in a closed position and FIG. 7B shows the plunger stem in an open position.

DETAILED DESCRIPTION OF PREFERRED EMBODIMENT

Figure 5:
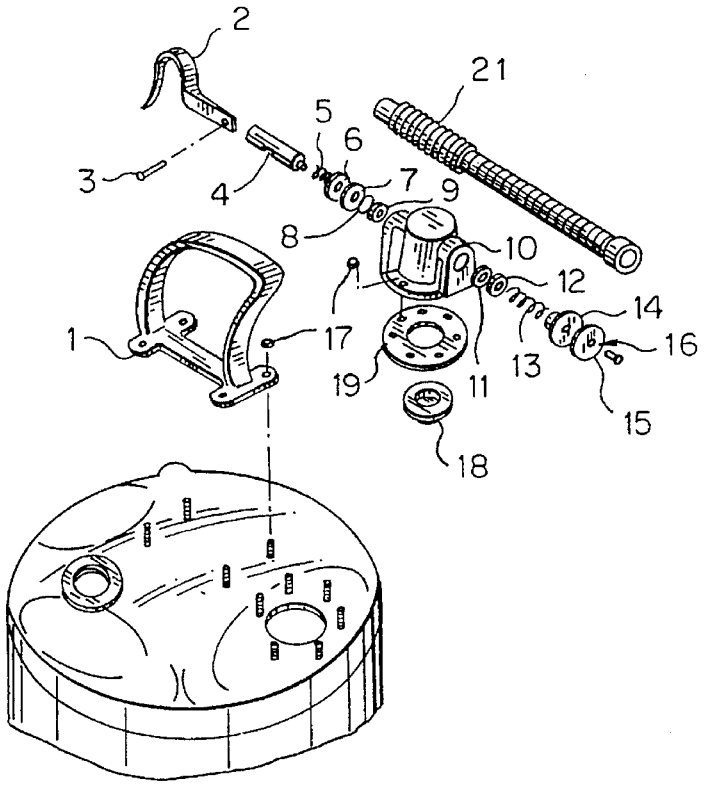
FIG. 5 is an exploded view of one embodiment of the pour spout assembly and handle of the gasoline container according to the invention.

As shown in FIG. 1, the gasoline container 100 is cylindrical in shape and has a pour spout assembly 102 disposed on top of container 100. Pour spout 102 has a spring biased valve 104 which can be opened against the action of the spring by grip 106 to discharge the contents of the gasoline container 100 through flexible nozzle 21. Carrying handle 110 is provided to assist a user in carrying the container and in discharging its contents.

A threaded fill spout 112 is also located at the top of container 100 to allow entry of gasoline into container 100. Fill spout 112 is provided with threads which can engage the corresponding threaded pressure relief cap 114. As shown in FIG. 1, pressure relief cap 114 is engaged to a top portion of container 100 by a flexible chain 116 to preclude its loss.

The above described features permit use of the pressure relief cap 114 while utilizing container 100 both in the workplace and during vehicular transport of container 100, thereby meeting different sets of regulations and requirements.

As shown in FIGS. 1 and 2, pressure relief cap 114 is provided with grip flange 118 which has multiple parallel sides to permit easy user fastening or removal of the cap to and from container 100. Wrench 120, with an opening mouth equal to the distance between parallel sides of grip flange 118, is separately provided to further facilitate user removal and fastening of pressure relief cap 114 and can be engaged to wrench storage clip 126 on the inside of skirt 122 for easy access by the user. In addition, wrench 22 is preferably secured to container 100 by a flexible chain 128 to preclude its loss.

As shown in FIG. 1, the pressure relief cap 114 fastened in fill spout 112 and pour spout assembly 102 are protected from unintentional opening or damage by cylindrical skirt 122, integrally engaged to the periphery of the top portion of container 100. Skirt 122 can be made from the same metallic material as container 100 or from impact-resistent plastic or fiber glass. As indicated, protection skirt 122 rises vertically from the top periphery of container 100 past the uppermost point of the pressure relief cap 114 and pour spout assembly 102. Skirt 122 is provided with a plurality of drain holes 124 proximate to the line of connection between the top of container 100 and skirt 122. In addition, a hole is provided in skirt 122 to permit passage of flexible nozzle 21 of pour spout assembly 100, thereby, facilitating discharge of the contents of container 100.

Another embodiment of the gasoline container is shown in FIG. 3, where the gasoline container 130 is of a generally rectangular shape. In a similar fashion to the cylindrical gasoline container embodiment shown in FIG. 1, a generally rectangular skirt 132 is integrally engaged to the periphery of the top portion of container 130. In addition, rectangular skirt 132 can be made from the same materials as cylindrical skirt 122 and also functions as well to protect the fill spout 112 and pour spout assembly 102 from unintentional opening or damage. However, a particular advantage of the generally rectangular shape for the gasoline container shown in FIG. 3 is its stability to tipping in any direction. While the gasoline container embodiment of FIG. 3 is stable to a 30 degree incline in any direction, conventional gasoline containers generally do not exhibit such stability to tipping when inclined to about 30 degrees. Preferably, the gasoline containers of the invention are 1, 2, 2.5, 3, or 5 gallons, or 1 or 5 imperial gallons in size.

The pressure relief cap 114, shown in FIG. 4, is used in all embodiments of the invention and is provided with a spring to release pressure when the internal gas pressure in the gasoline container exerts a force on the spring that exceeds a threshold or predetermined pressure. The top section of cap body 140 of the pressure relief cap 114 is formed by a plate 158 which is integral with a lower cylindrical portion 142 partially threaded on the outside. Plate 158 is provided with a centrally located throughhole 162 and grip flange 118 having at least two parallel sides. The cylindrical portion of cap body 140 curves inward at the bottom of the cap body to form a circular inner lip 160 that maintains contact with a circular gasket 146 to provide a seal. The spring 152, compressed between an outer spring retainer 156 and an inner spring retainer 154 disposed against the bottom of cap body 140, is connected to gasket cap 144 and gasket 146 through a connecting post 150. Post 150 is secured at one end to gasket cap 144 and at its other end to the outer spring retainer 156 by assembly bolts 148.

Upon assembly of the pressure relief cap 114, spring 152 forces gasket 146 into tight contact with the circular inner lip 160 of the cap body to effect an airtight seal when the pressure relief cap is securely engaged in the fill spout 112. This airtight seal can be temporarily broken in the event of excessive internal pressure within the gasoline container.

Spring 152 is preferably a wave spring, known in the spring industry as a flat wire series of discs or washers of very thin spring steel. These series of thin spring steel discs or washers have a spring temper which will exert a force upon compression similar to a compression coil spring but with a more linear spring constant. The inner spring retainer 154 is provided with throughholes to allow communication between the gasoline vapors and gasket 146. As pressure is exerted on the inner surface of gasket 146, a counter force is applied against the compressive force of spring 152. The gasket cap and gasket will lift open from its airtight engagement with inner lip 160 at an internal pressure of 5 psi (34 kPa) within the container. The spring force of spring 152 is approximately 7 lbs. for a gasket surface area (approximately 1.4 $in^2$) on which the internal gas pressure is exerted.

Figure 6:
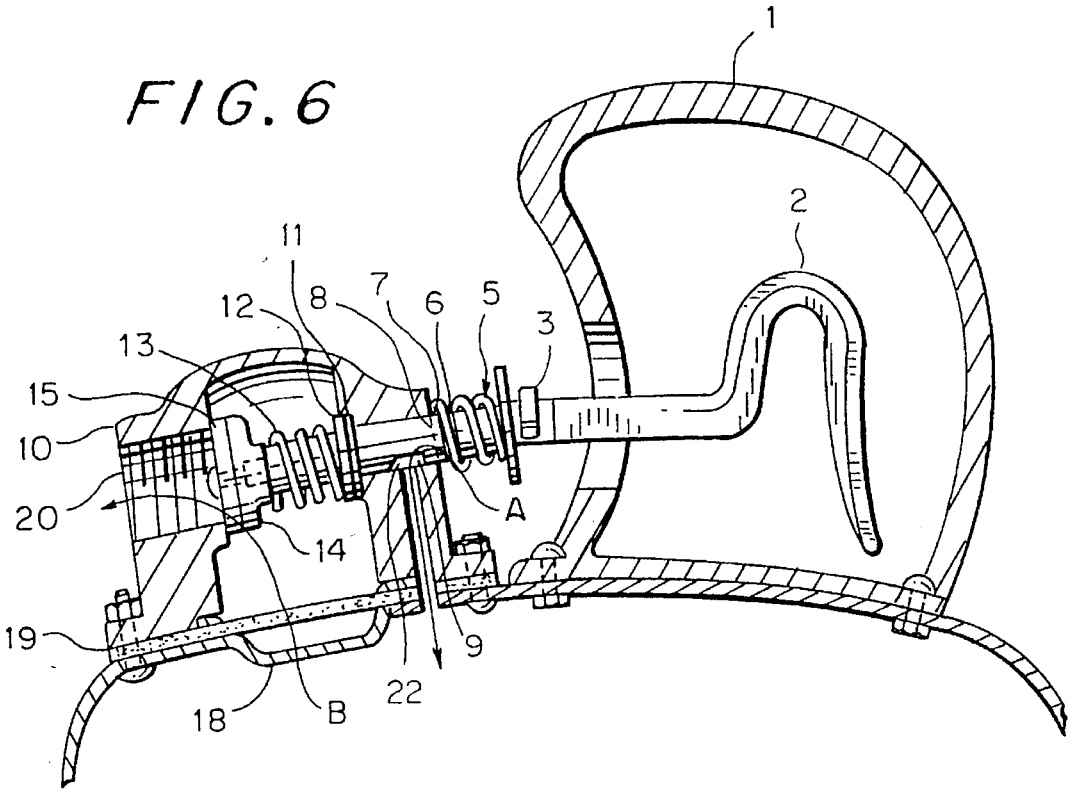
FIG. 6 is a cross-sectional side view of the pour spout assembly and handle of FIG. 5.

In FIGS. 5 and 6, the pour spout assembly and handle are presented in an exploded view and a cross-sectional view, respectively. The pour spout 10 is secured to the top of gasoline container 100 by fasteners with a spout gasket 19 and a flame arrestor 18 sandwiched therebetween. When secured to the gasoline container, the pour spout allows the contents of the gasoline container to communicate with the outside when gasoline is discharged along the path represented by the arrow B and by the entry of air along the path represented by arrow A. In its stored position, the outer plunger spring 5 and the inner plunger spring 13 forces large outer plunger gasket 7 and plunger seat gasket 15, respectively, to seal the interior of the gasoline container from accidental discharge of gasoline through the pour spout assembly. The outer plunger assembly is composed of an outer plunger spring 5 disposed over a plunger stem 4 having a notch 22 on its underside, and connected to a washer 6, large outer plunger gasket 7, retainer ring 8, and a small outer plunger gasket 9 in series at one end. The inner plunger assembly is composed of an inner plunger spring 13 connected to a washer 12 and an inner plunger gasket 11 at one end and to a plunger end flange 14 and plunger seat gasket 15 at its other end. The outer plunger assembly and the inner plunger assembly are secured together as one unit within pour spout 10 by the engagement of a threaded screw 16 with a correspondingly threaded hole at the end of plunger stem 4. A flexible nozzle 21 is threaded at one end for attachment to a corresponding threaded discharge port 20 of pour spout 10 to serve in discharging gasoline from the container.

The plunger stem 4 is attached either to pull handle 2 as shown in FIGS. 5 and 6 by a cotter key 3 or to pull handle 106 as shown in FIGS. 1–3 with the pull handles 2 and 106 positioned relative to carrying handles 1 and 110, respectively, in such a manner as to permit easy one-handed operation of the pour spout assembly.

To discharge gasoline from the container, the pull handle is pulled in the direction of the carrying handle and the plunger seat gasket 15 is pulled away from its airtight seal with the inner wall of pour spout discharge port 20. In this operating position, the plunger seat gasket 15 is disengaged from its sealed storage position to allow for discharge of gasoline along the path of arrow B while air is automatically vacuum vented into the gasoline container along the path of arrow A through the air inlet passage (FIG. 7B).

Figure 7A:
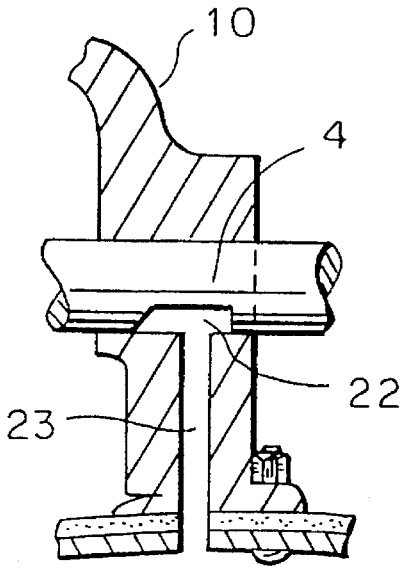
FIG. 7A and 7B are cross-sectional side views of a portion of the pour spout assembly of FIG. 5 where
Figure 7B:
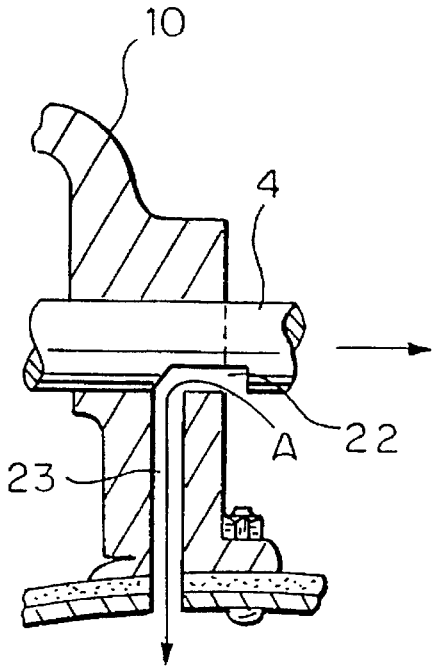

In FIG. 6 and FIG. 7A, the plunger stem 4 with notch 22 is shown in a closed position. During gasoline discharge operation, the plunger stem 4 is pulled in the direction of the arrow shown in FIG. 7B into an open position where plunger stem 4 with notch 22 is displaced and positioned over air inlet passage 23 to permit communication of the container contents with the atmosphere. Air is thus vacuum vented into the container following the path indicated by arrow A in FIG. 7B when the plunger stem/pull handle is pulled during gasoline discharge operation.

The foregoing description of the specific embodiments reveal the general nature of the invention so that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A safety gasoline container, comprising:

a container having an interior and a top outer surface with a periphery;

a carrying handle mounted on said top surface of said container;

a pour spout assembly mounted on said top outer surface of said gasoline container, comprising:

a pour spout having both a threaded gasoline discharge port and an air inlet passage communicating with said interior of said container;

a flexible nozzle having one end threaded to engage with said threaded gasoline discharge port;

a pull handle;

a plunger stem having an inner end, an outer end, and a longitudinal axis, said outer end being connected to said pull handle, said plunger stem having a notch centrally disposed along said longitudinal axis and said notch capable of communicating with said air inlet passage and the outside atmosphere in an open operating position upon actuation of said pull handle;

a seat gasket being securably attached to said inner end of said plunger stem;

an inner plunger spring surrounding said plunger stem at said inner end along said longitudinal axis to force said seat gasket to seal said gasoline discharge port, said seat gasket being unseated from said gasoline discharge port upon actuation of said pull handle to discharge gasoline;

an outer plunger spring surrounding said plunger stem at said outer end along said longitudinal axis;

a skirt integrally engaged to said periphery of said outer top surface of said container and extending to a point above said pour spout assembly, said skirt having a plurality of drainholes proximate to said periphery of said outer top surface and a throughhole for said flexible nozzle; and a pressure relief cap, comprising:

a cap body having a top section, a lower cylindrical section, and a bottom, said top section being formed from a flat plate having a central throughhole and a grip flange along its edge, said grip flange having at least one pair of parallel sides, said lower cylindrical section being partially threaded and integrally joined with said flat plate, said lower cylindrical section curving inward and upward from said bottom of said cap body to form a circular inner lip;

a circular inner spring retainer having throughholes and being disposed against said bottom of said cap body;

a circular outer spring retainer;

a spring disposed between said circular inner and outer spring retainers;

a circular gasket being in contact with said circular inner lip of said cap body;

a circular gasket cap disposed against said circular gasket and fastened to said spring and said inner and outer spring retainers by a post whereby the action of said spring urges said circular gasket against said circular inner lip of said cap body to form an airtight seal.

2. A safety gasoline container as recited in claim 1, wherein said container and said skirt are generally cylindrical in shape.

3. A safety gasoline container as recited in claim 1, wherein said container and said skirt are generally rectangular in shape.

4. A safety gasoline container as recited in claim 1, wherein said pressure relief cap further comprises a flexible chain for securing said pressure relief cap to said top outer surface of said container.

5. A safety gasoline container as recited in claim 1, further comprising a wrench for removing or tightening said pressure relief cap, a flexible chain for securing said wrench to said top outer surface of said container, and a wrench retaining clip mounted on said skirt for storing said wrench.

* * * * *